United States Patent [19]

Faure

[11] 4,373,233

[45] Feb. 15, 1983

[54] DRIVE SYSTEM AND DRAWFRAME SYSTEM FOR A ROVE DRAWING PROCESS

[75] Inventor: Jean-Louis Faure, Roanne, France

[73] Assignee: ASA S.A., Villeurbanne, France

[21] Appl. No.: 201,238

[22] Filed: Oct. 27, 1980

[30] Foreign Application Priority Data

Nov. 5, 1979 [FR] France ..... 79 27624

[51] Int. Cl.[3] ..... D01H 5/18; D01H 5/86

[52] U.S. Cl. ..... 19/236; 19/244; 19/258; 19/293

[58] Field of Search ..... 19/236, 239, 240, 241, 19/244, 258, 293, 25, 248

[56] References Cited

U.S. PATENT DOCUMENTS

| | | | |
|---|---|---|---|
| 1,885,423 | 11/1932 | Fenton | 19/25 X |
| 3,327,464 | 6/1967 | Halleux | 57/83 |
| 3,748,694 | 7/1973 | Staneff | 19/293 X |
| 4,033,102 | 7/1977 | Van Helle | 57/12 |

FOREIGN PATENT DOCUMENTS 286439 10/1952 Switzerland .

*Primary Examiner*—Louis Rimrodt

*Attorney, Agent, or Firm*—Arnold, White & Durkee

[57] ABSTRACT

A drive system for a drawframe for a rove drawing process in which the drawframe includes at least one pair of feed rollers, at least one pair of sleeves, at least one pair of drawing rollers, and at least one swinging arm on which one feed roller, one sleeve and one drawing roller of each pair is supported, the swinging arm being displaceable between an inoperative position and an operative position where the pair of feed rollers, pair of sleeves and pair of drawing rollers are engaged under pressure for rove drawing. The drive system includes a drive shaft and at least one displaceable friction clutch roller which is displaceable between an operative position to engage both the drive shaft and one of the feed rollers for transmitting drive from the drive shaft to the feed roller, and an inoperative position where it is disengaged from the feed roller, the friction clutch roller being displaceable into its operative position to allow progressive engagement of the drawframe at start up.

10 Claims, 4 Drawing Figures

DRIVE SYSTEM AND DRAWFRAME SYSTEM FOR A ROVE DRAWING PROCESS

The present invention relates to a drive system and to a drawframe system for the drawing process of a roving made from fibrous material and ready for spinning into thread or yarn.

It relates in particular to the engaging and disengaging of a clutch system for drawframes equipped with sleeves, as well as to the application of this system especially to spinning machines producing self-twisting yarns.

Until recently spinning frames equipped with sets of drawframes for processing a roving did not have any means to release each position separately and to stop the machine if the roving being fed breaks.

Consequently, the risk of slivers becoming wound around the rotating rollers was very high, and, in addition, it was a very difficult to restart after each interruption.

With the introduction of the "open-end" spinning technique, and especially since this technique makes it possible to noticeably increase the rates of production, systems for separately starting and stopping each drawing device were suggested.

However, the solutions offered to solve this problem were not fully satisfactory. They have certain disadvantages due to the fact that, in particular, when operation is resumed, restarting is sudden. Therefore, taking into account the high production rates, the roving is sometimes caused to break.

Some machines are also known which produce self-twisting yarns, and especially types of self-twisting yarns with a central strand in the core of at least one of its constituent elements (U.S. Pat. No. 4,033,102).

Generally, these machines have, for each operating position, a drawing device allowing simultaneous processing of two rovings, with a core enclosed into at least one of the rovings before the last pair of drawing rollers.

On such machines, it is essential that the drawing system of the rovings be equipped with a self-release device to release if the rove breaks. This is essential because the winding operation will continue due to the existence of the core.

Therefore, these systems must also be capable of automatically cutting the cores and stopping the winding operation, or inversely, they should be controlled by devices capable of detecting if either the core or the yarn produced breaks.

The system devised in the present invention fulfills these objectives.

Moreover, this system makes it possible to progressively start the drawing of the roving and to operate with sudden stops and starts. This is a distinct advantage for the restart operation. Finally, it can readily be used for an intermittent or variable-speed delivery of the material processed, in particular for the production of yarns with a flamelike appearance lengthwise.

Generally, this invention relates to a drive system for the drawing process of at least one roving made from fibrous material and ready for spinning, the system including a drawframe consisting of two feed rollers, two sleeves, and two drawing rollers, with all of these elements, under normal operating conditions, being maintained under pressure by means of a swinging arm which may be moved into and out of the operating position, the arm holding one of the feed rollers, one of the sleeves, and one of the drawing rollers, a control system being provided to start and stop each drawframe of the equipment, and the system being characterized by the fact that the feed rollers, at least when starting up, are driven by a friction clutch roller connected to every operating position, the movable roller, when engaged, being positionable to come into contact with both one of the feed rollers and a driving shaft which extends throughout and parallel to the length of the frame and which is spaced from such a driven feed roller.

The invention further extends to a drawframe system including such a drive system.

According to the system of this invention, the two drawing rollers are driven in a conventional manner, one of these rollers being in the form of a spliced driving shaft which extends through the system to provide the same roller for every operating position, with the other drawing roller which is held by the swinging arm, resting thereon.

The clutch roller connected to every operating position will be made from a material suitable for a friction drive, such as the material marketed under the commercial brand of VULKOLAN.

An advantage provided by the invention is that the sleeves of the drawframe system may be directly driven by the driving feed roller by means, for instance, of a belt connecting this roller to a shaft bearing one of the sleeves.

According to this invention, the motion of the clutch roller is operated by any appropriate means, such as for instance a lever system.

In one of the applications of the invention, the engaging and disengaging system is connected by means allowing the self-release of the clutch roller, which may be controlled either by a device for detecting if the roves break or by other safety devices, such as one for detecting if the yarn produced breaks.

In another variation of the invention, the clutch system, as indicated above, has a roller connected to every operating position. This clutch roller, during the startup operation, can be engaged by coming into contact with both one of the feed rollers and a driving shaft which extends throughout the length of the frame. This clutch roller may be mounted on a support allowing said roller to be disengaged in the normal course of operation, which simultaneously changes the friction clutch system into a positive clutch system, such as for instance a pinion which becomes engaged into a mating pinion on the driving shaft.

Lastly, according to this invention, the system may be connected to devices allowing the clutch roller to engage on and off with the driving shaft in order to change the production rate of the rove process.

This invention and its advantages will be understood more clearly with the aid of an example, which is not intended to limit the scope of the invention, which is given as a guide with reference to the attached drawings:

FIG. 1 shows a two-sleeve drawframe equipped with a clutch system to be connected and disconnected in accordance with the invention.

Figure 1:
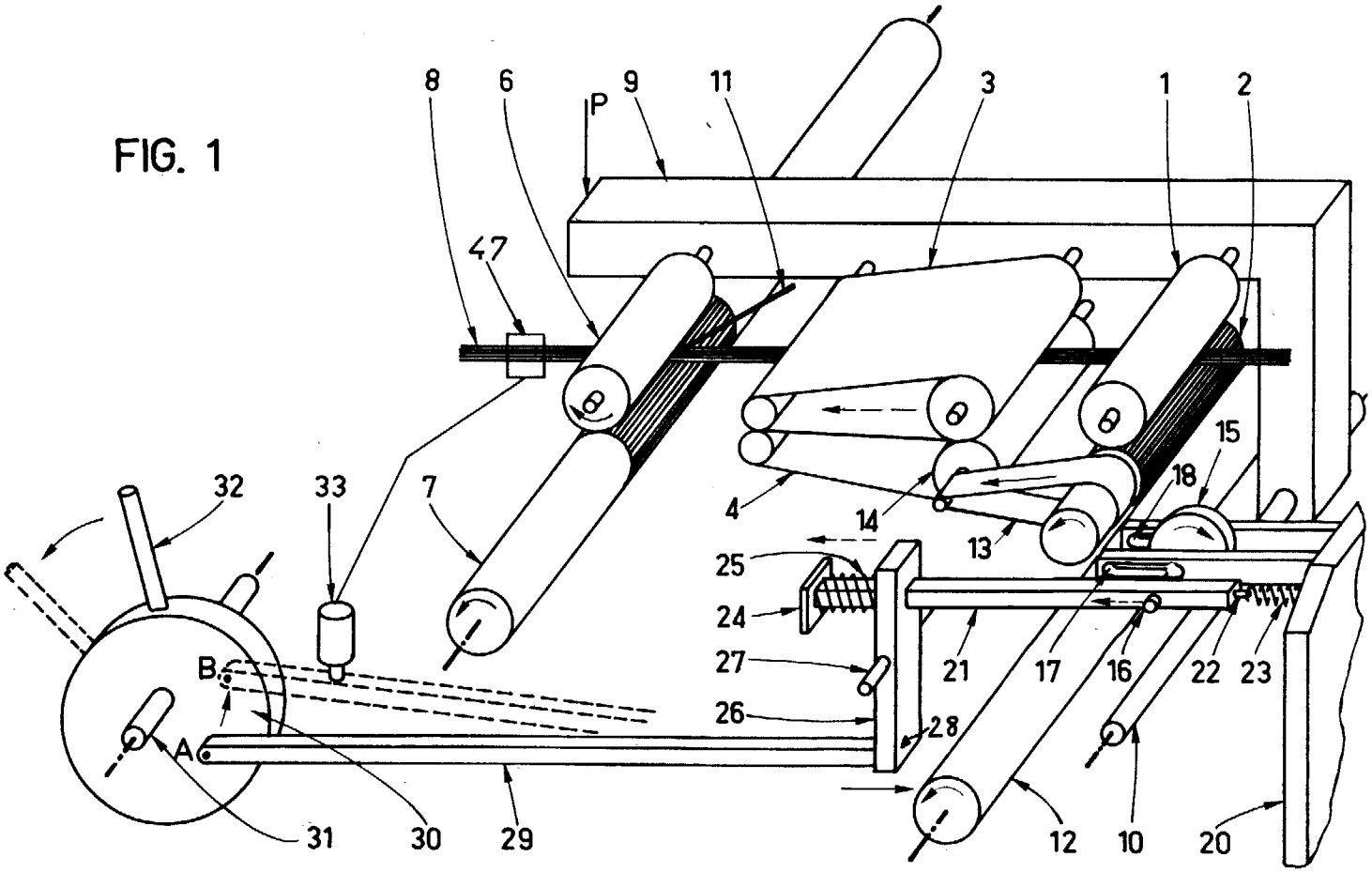
FIG. 1 is an overall diagrammatic view of the device according to the invention.

This drawframe system consists essentially of a pair of feed rollers 1 and 2, a pair of sleeves 3 and 4, and a pair of drawing rollers 6 and 7. This figure does not show the source of the roving 8 being fed. The roving emerging from the drawing rollers is ready for any conventional process.

A swinging arm 9 supports the roller 1, the sleeve 3, and the roller 6, and is assembled to rotate on a stationary shaft 10 which extends throughout the length of the frame and is connected to multiple operating positions.

Generally, the swinging arm 9 will hold two drawing units in symmetrical positions on both sides of this swinging arm. FIG. 1, however, shows only one drawing unit for the sake of clarity.

Moreover, as is known in the art, a core 11 may have been inserted into the roving 8 immediately before being fed to the two drawing rollers 6 and 7.

The arrangement of this assembly may be horizontal, as shown in FIG. 1, or vertical, or oblique.

A conventional pressure system operative on the swinging arm 9 allows the elements 1, 3, and 6 to be maintained under a fixed pressure with the grooved feed roller 2, the sleeve 4, and the grooved drawing roller 7 when the arm 9 is in its operative position.

There is a separate feed roller 2 for each operating position, whereas the roller 7 extends throughout the length of the frame and thus constitutes the same splined shaft for all positions throughout the length of the frame.

The roller 2 controls, for instance through a belt 13, the drive of a shaft 14 bearing the sleeve 4.

A driving shaft 12, parallel to the roller 2 and spaced from it, extends throughout the length of the frame.

According to the invention, connection and disconnection of the drawframe is performed by means of a friction clutch roller 15 which, by means of a lever system can move to be connected with the rollers 1 or 2 (starting position) or to be disconnected from them (stopping position). The clutch roller 15 may, for example, be made of VULKOLAN.

In this arrangement, the motion of the clutch roller 15 is controlled as follows. The clutch roller 15 is mounted on an axle 16 which is slidably located in grooves 17 and 18. The grooves are defined in members supported by the frame structure 20. The axle 16 is locked to a rod 21 having one end 22 positioned for a draw spring 23 to act against it to maintain the clutch roller 15 disconnected from the shaft 12 and the roller 2. The other end 24 of the rod 21 is biased by a spring 25 resting on the rear face of a lever 26 linked to an axle 27 which extends throughout the length of the frame. The other end 28 of the lever 26 is driven by a lever 29 eccentrically mounted on a disc 30 which can rotate around an axle 31 between two positions A and B. Position A corresponds to the starting position of the clutch roller 15, and position B to the stopping position of the roller. Only the starting position A has been shown, and a dotted line shows the lever 29 in the stopping position B. Rotation of this lever 29 may be manually controlled by a handle 32 installed at the periphery of the disc 30, or by release means in the form of a jack 33, for example, which has its bar resting against the lever 29, and which becomes released in case of accident, such as when the roving breaks.

The operation of such a drawing system is as follows. In the starting position A (shown in solid lines in FIG. 1), the clutch roller 15 is maintained in a position disconnected from the driving shaft 12 and the roller 2 by means of the return spring 23 whereas, in the stopping position B (shown in dotted lines) the end of the lever 29 moves to B, which causes the lever 26 to be rocked and thus the clutch roller 15 is maintained against the driving shaft 12 and the roller 2 by means of the spring 25.

When a roving breaks, a detector (47 of any conventional type) controls the release of the jack 33 through an electromagnetic valve, the jack's bar pushing the lever 29 back into position A, and allowing the return of the clutch roller 15 triggered by the spring 23.

When restarting, it is through the handle 32 that the connection will be made, the clutch roller 15 moving to come into contact with the driving shaft 12 and the roller 2. It may be done progressively, or even intermittently, thereby resulting in a more efficient restart of the processing of the roving 8.

Figure 4:
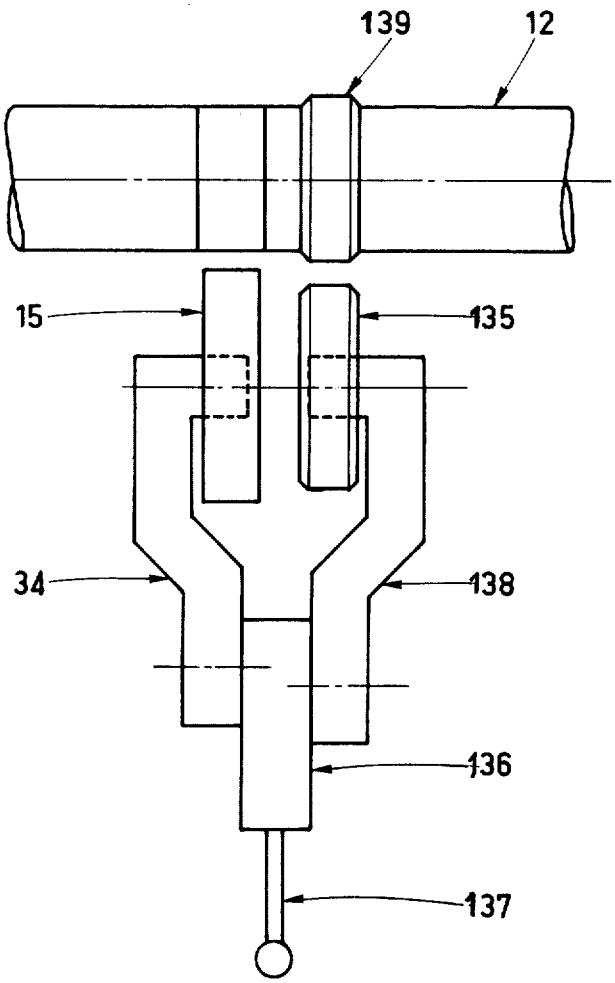
FIG. 4 shows a variation of the clutch system according to the invention, which can be progressively engaged during the startup operation, and can be operated as a positive clutch system in the normal course of operation.

In the variation shown in FIG. 4, the clutch roller 15 drive procedure is similar to the one described for the restarting operation. However, in this variation, the clutch roller 15 is mounted in such a manner that, in the normal course of operation, it is possible to disengage the clutch roller 15 and simultaneously cause the shaft 12 to be driven by a pinion 135 with a positive drive as a result. To that effect, we can use an assembly with a cam 136 which can be rotated manually by means of a lever 137. This cam holds the support 34 of the clutch roller 15 and also the support 138 for the pinion 135. When starting up, triggering of the lever 137 is sufficient to cause the cam 136 to rotate, which pushes back the clutch roller 15 and simultaneously engages the pinion 135 into a mating pinion 139 on the driving shaft 12.

These devices, such as the one shown in FIG. 1 or the variation shown in FIG. 4, are especially adequate for the production of self-twisting yarns in which a core is inserted in at least one of the emerging rovings. However, these devices are not limited to this type of operation.

Figure 3:
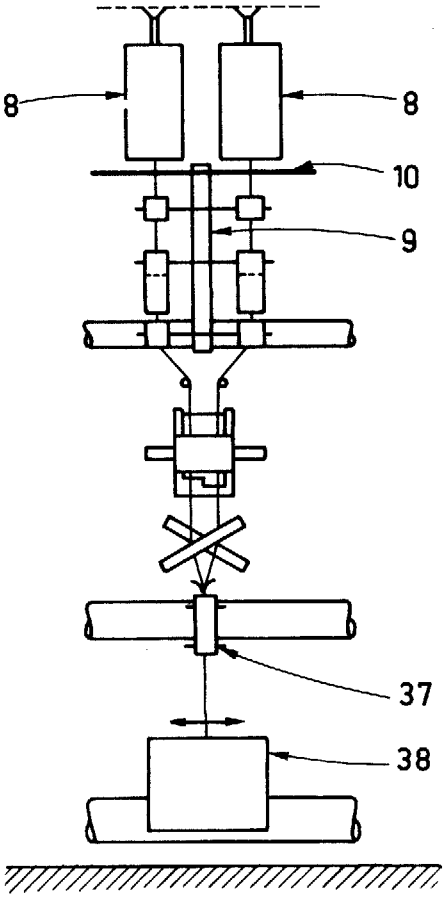
FIGS. 2 and 3 are respectively side and plan views of an operating position of a self-twisting frame equipped with a drawframe of rovings according to the invention.
Figure 2:
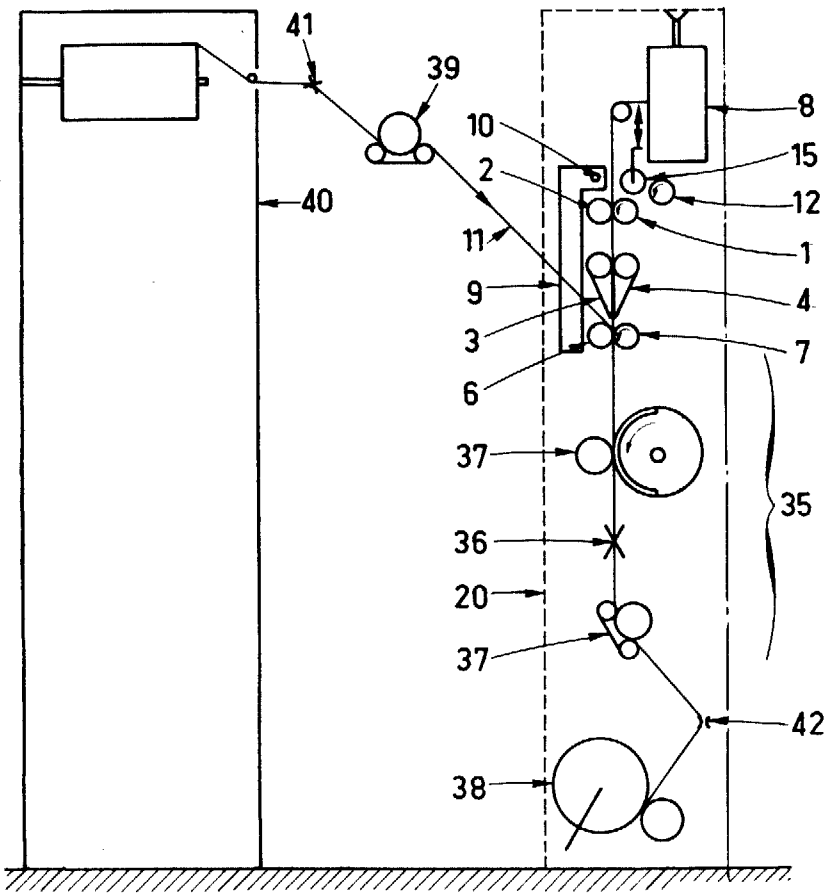

FIGS. 2 and 3 illustrate this application.

In these figures, only the main elements of the device previously described and illustrated in FIG. 1 are shown. These elements are the two feed rollers 1 and 2, the two sleeves 3 and 4, the two drawing rollers 6 and 7, the swinging arm 9, and the shaft 10 of the swinging arm 9. As for the starting and stopping clutch system proper, only the clutch roller 15 and the driving shaft 12 are shown in FIG. 2.

This drawframe system, which can produce self-twisting yarns with a core, is designed for multiple identical operating positions, which are arranged side by side on a supporting frame structure.

The feeding-in of the roving to be processed is illustrated in the upper part of the frame structure 20. The equipment for the rove processing consists of a drawframe vertically arranged on this supporting frame structure, and a self-twisting system 35 including for instance a false twisting spindle 36 and a device 37 with which the length of the twisting operation can be varied (intermittent delivery) and which is installed below the two drawing rollers 6 and 7. The two yarns processed, once self-twisted together, are delivered through a conventional delivery roll 37 to be wound further on reel 38.

The feeding-in of core threads is carried out by a delivery roll 39, these threads coming out of a creel 40 located outside the frame and facing it.

This installation is equipped with the same devices to allow the self-release of the drawframe units if the thread breaks. These devices are connected to a thread cutter 41 for the core thread and to a winding control detector 42.

If the roving 8 breaks, the drawframe system is disconnected as described in the example illustrated in FIG. 1, but simultaneously the thread-cutter 41 is activated while the winding at 38 is being stopped. Likewise, if the core thread happens to break, the thread-cutter 42 automatically triggers the control for the release of the drawframe units.

During the restarting operation, the connection is performed as described previously, and this operation may be carried out progressively by the clutch roller 15 moving to come into contact with the driving shaft 12 and the roller 2.

During the normal course of operation, a positive clutch connection may eventually be performed as described in the example illustrated in FIG. 4.

Consequently, the drawing system, as per the invention, greatly insures the safe operation of the equipment with which it is installed.

Moreover, with respect to the above systems of individual release of the drawframe units, it also makes the restarting operations more efficient due to the fact that the drawing elements may be kept under pressure before the roving goes through, and especially since it is possible to start by progressively engaging the clutch system, which is particularly valuable in the case of machinery operating at high speeds.

The invention, of course, is not limited to the procedures and arrangements previously described, but also applies to all variations therefrom of a similar design. As it was mentioned earlier, the starting and stopping clutch systems devised by the invention can easily be coupled to an intermittent control system in order to obtain yarns with varying design effects lengthwise.

What is claimed is:

1. A drive system for a drawframe for a rove drawing process, in which the drawframe includes at least one pair of feed rollers, at least one pair of sleeves, at least one pair of drawing rollers, and at least one swinging arm on which one feed roller, one sleeve and one drawing roller of each pair is supported, the swinging arm being displaceable between an inoperative position and an operative position where the pair of feed rollers, pair of sleeves and pair of drawing rollers are engaged under pressure for rove drawing, the drive system comprising a drive shaft and at least one displaceable friction clutch roller which is displaceable between an operative position to engage both the drive shaft and one of the feed rollers for transmitting drive from the drive shaft to the feed roller, and an inoperative position where it is disengaged from the feed roller, the friction clutch roller being displaceable into its operative position to allow progressive engagement of the drawframe at start up.

2. A system according to claim 1, including a clutch lever system on which the friction clutch roller is supported, the clutch lever system being operable to displace the friction clutch roller between its operative and inoperative positions.

3. A system according to claim 1 or claim 2, including release means for releasing the friction clutch roller to displace the roller into its inoperative position, the release means being responsive to breaking of a rove or yarn being processed to release the friction clutch roller.

4. A system according to claim 3, including a detecting device for detecting a break in yarn or rove being processed, and for controlling the release means to release the friction clutch roller.

5. A drawframe system for a rove drawing process, the system comprising at least one pair of feed rollers, at least one pair of sleeves, at least one pair of drawing rollers, at least one swinging arm on which one feed roller, one sleeve and one drawing roller of each pair is supported, the swinging arm being displaceable between an inoperative position and an operative position where the pair of feed rollers, the pair of sleeves and the pair of drawing rollers are engaged under pressure for rove drawing, at least one drive shaft, and at least one displaceable friction clutch roller which is displaceable between an operative position where it engages both the drive shaft and one of the feed rollers for transmitting drive from the drive shaft to the feed roller, and an inoperative position where it is disengaged from the feed roller, the friction clutch roller being displaceable into its operative position to provide for progressive engagement of the drawframe during start up.

6. A system according to claim 5, comprising a splined driving shaft which extends through the drawframe, the splined driving shaft having one drawing roller of the pair of drawing rollers supported thereon, and being adapted to have further drawing rollers of further pairs of drawing rollers supported thereon at intervals along its length.

7. A system according to claim 5, including a shaft on which one of the sleeves of the pair is mounted, and including a belt connecting the shaft to one of the feed rollers for the feed roller to drive the sleeve through the belt.

8. A system according to claim 5, including a clutch lever system on which the friction clutch roller is supported, the clutch lever system being operable to displace the friction clutch roller between its operative and inoperative positions.

9. A system according to claim 5 or claim 8, including release means for releasing the friction clutch roller to displace the roller into its inoperative position, the release means being responsive to breaking of a rove or yarn being processed to release the friction clutch roller.

10. A system according to claim 9, including a detecting device for detecting a break in yarn or rove being processed, and for controlling the release means to release the friction clutch roller.

* * * * *